US005371956A

United States Patent [19]

St. Louis

[11] Patent Number: 5,371,956

[45] Date of Patent: Dec. 13, 1994

[54] SNAP-IN BAFFLE FOR CLOTHES DRYER

[76] Inventor: Robert M. St. Louis, 8980 Rochette, St. Leonard, Quebec, Canada

[21] Appl. No.: 15,011

[22] Filed: Feb. 9, 1993

[30] Foreign Application Priority Data

Feb. 27, 1992 [CA] Canada ..... 2062016

[51] Int. Cl.[5] ..... F26B 11/02

[52] U.S. Cl. ..... 34/599; 34/602

[58] Field of Search ..... 34/133 R, 133 G, 133 D, 34/133 J, 133 E, 595, 599, 600, 602, 604

[56] References Cited

U.S. PATENT DOCUMENTS 3,017,758 1/1962 Haverstock et al. ..... 34/133 E 3,237,317 3/1966 Huebsch, Sr. ..... 34/133 D 3,938,357 2/1976 Leib ..... 34/133 D

FOREIGN PATENT DOCUMENTS 516791 9/1955 Canada .

903468 6/1972 Canada .

937043 11/1973 Canada .

967774 5/1975 Canada .

*Primary Examiner*—Denise L. Gromada

[57] ABSTRACT

This invention relates to a baffle for the tumbling of clothes in a domestic clothes dryer. The baffle is a "snap-in" baffle which may be installed in the drum through the door opening after final assembly of the dryer. No additional installation tools are necessary.

6 Claims, 2 Drawing Sheets

SNAP-IN BAFFLE FOR CLOTHES DRYER

Domestic clothes dryers in use today generally perform a drying operation by inserting the clothes to be dried into a rotating drum and blowing drying air which may be heated or unheated through the drum whilst the drum is rotated so as to cause the clothes in the drum to be tumbled as the drying air passes therethrough.

This invention relates to a baffle for use in a dryer drum which performs the function of tumbling the clothes but is made so that installation time of such drum baffle in the drum is drastically decreased over prior art baffles.

BACKGROUND OF THE INVENTION

Domestic clothes dryers whether utilizing gas or electricity for drying have traditionally utilized a rotating metallic drum journaled in suitable bearings for rotation about a central axis, so as to move the clothes about as the drying air is passing through the damp clothes. It is customary to mount a plurality of baffles on the inside surface of the drum to force the clothes undergoing drying to tumble to improve the efficacy of the drying operation. The baffles used in prior art dryers have taken on a variety of shapes, sizes and composition. Baffles of wooden construction, metal and at the present time plastic composition are generally favored. The shapes of the baffles have varied as greatly as the compositions of the baffles. It is not unusual to have upright baffles of uniform height which extend across the width of the drum. Other designs have provided baffles of varying height across the width of the drum and the baffle may be curved to force the clothes to tumble in a prescribed fashion within the drum.

One feature that all prior art baffles had in common was the method of attachment to the drum, and in all cases the prior art baffles were secured to the drum with screws from the exterior of the drum. This method of fastening, while reasonably fast and positive, requires assembly of baffles and drum before the final assembly of the dryer cabinet is completed.

During the manufacture of the drum, a baffle is inserted into a "jig" and the drum and jig are brought together so that the baffle is held in a predetermined place on the inside surface of the drum where it may be suitably mounted and fasteners such as screws or bolts and nuts are passed through suitable holes in the drum into holes or recesses in the baffle and tightened to firmly hold the baffle in place. Generally three fasteners are sufficient to hold a single baffle in place. The process is repeated for the balance of the baffles to be installed in the drum, which in most dryer drums will include two additional baffles.

The baffle of the present design is made from a suitable plastic material and is to a great extent hollow. The mounting surface of the baffle is provided with a pair of tongues which protrude in a forward direction which is generally perpendicular to the clothes engaging front surface of the baffle, whilst being integrally fastened to and protruding from the lower surface of the baffle (which subsequently mates with the drum).

Similarly the rear surface of the baffle is provided with a pair of "hooked" projections which extend below the mating surface of the rear surface of the baffle so as to engage and hook into a pair of cooperating recesses in the drum.

This baffle is manufactured so that the two protruding tongues on the forward leading edge of the baffle are inserted into two cooperating apertures in the drum and when suitable penetration has occurred the baffle is pivoted at the line of intersection of the two tongues to bring the rearward surface of the baffle into contact with the drum such that the pair of "hooked" projections are inserted into two mating apertures in the drum until the hooks engage the exterior surface of the drum to positively lock the baffle in place.

This method of construction means that baffles do not need to be inserted in the drum during manufacture, and may be installed by the manufacturer, dealer or even a customer. In the event that a baffle is broken during use it is easily replaced without dismantling the dryer.

Referring now to the drawings.

Figure 1:
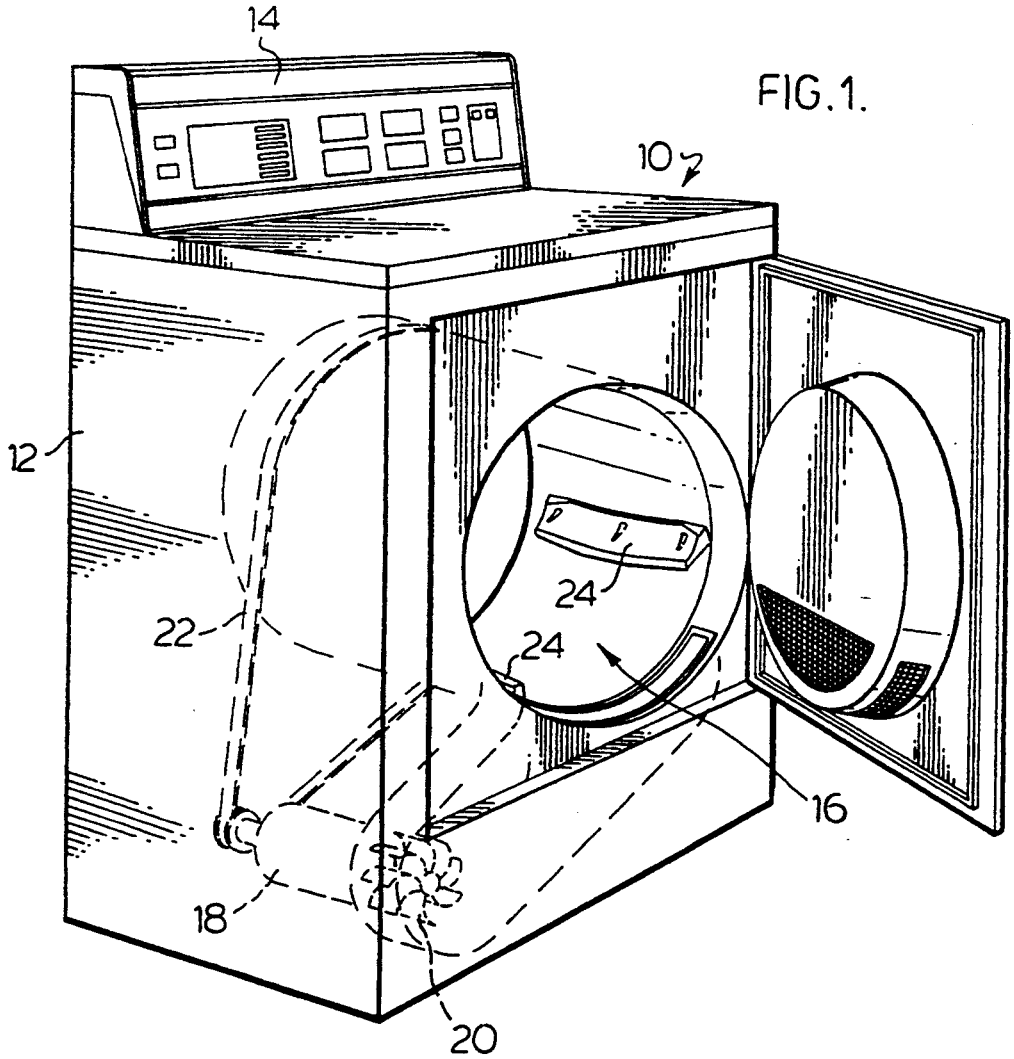
FIG. 1 is a perspective view of a domestic clothes dryer showing the drum and baffle of this invention.

Referring now to FIG. 1, a domestic clothes dryer 10 is illustrated to show some of the basic details of the construction. The dryer may be heated by gas or electricity for the purpose of this invention, no difference in the application of this invention to the dryer will be experienced for dryers heated by either of the above methods. Dryer 10 is supplied with a suitable cabinet or housing 12 for mounting the control panel 14, drum 16, motor 18 and blower 20. The cabinet 12 is supplied with a door (not shown) to give the user access to the drum 16.

Drum 16 is mounted in the cabinet 12 for rotation about its central axis and motor 18 is arranged to drive the drum by means of belt 22. The drum is also located in an air path so that the dry heated air is forced through the drum to extract moisture from the tumbling clothes therein.

Figure 2:
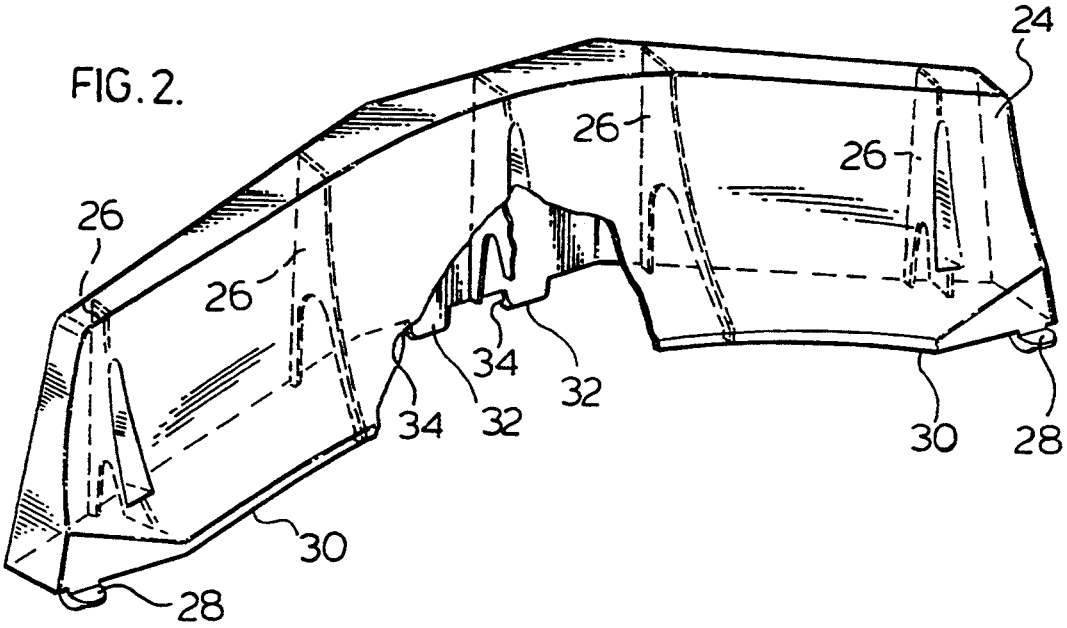
FIG. 2 is a perspective of the baffle of this invention.

The drum is provided with a set of baffles, one of which is shown at 24 in FIG. 1. The baffle is illustrated in FIG. 2. Basically the baffle is a substantially hollow molded plastic device which may be made of vinyl, or polypropylene, NORYL® or some other high impact plastic material which will not lost its strength at drying temperatures and which has a resilient nature. The baffle of the present invention is slightly curved so as to encourage the clothes to tumble toward the center of the drum 16 during a drying operation. In order to minimize the amount of material in the sidewalls of the baffle, suitable struts or webs 26 are formed therein to provide wall rigidity to the thin walled structure of the baffle 24.

At the lower surface of the extremities of the baffle 24 are two tongues 28 which are integrally molded into the baffle. Tongues 28 extend below the lower surface 30 of the baffle 24 and protrude in a forward direction as the baffle moves during rotation of the dryer drum 16. The distance that tongue 28 protrudes is not critical but in this instance a distance in the order of one-third of the distance between the front and rear surfaces of the baffle at the extremities will be found to be satisfactory.

In the central area of the lower rear surface of the baffle 24, a pair of protruding "hooking" members 32 are formed. Members 32 extend slightly below the lower rear surface of the baffle and have a pair of protruding hooks protruding rearwardly of the rear surface. The protrusion of hooks 34 is not critical but hooks 34 may protrude a distance equal to the width of the thickness of the walls of the baffle 24.

Figure 3:
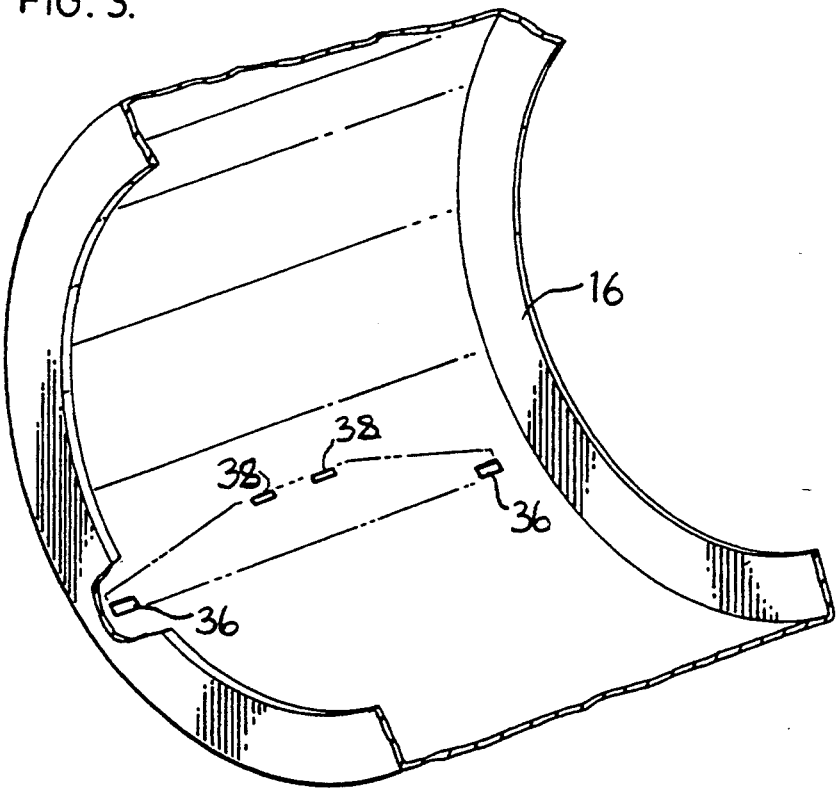
FIG. 3 is an enlarged view of the drum and baffle showing the installation thereof.
Figure 4:
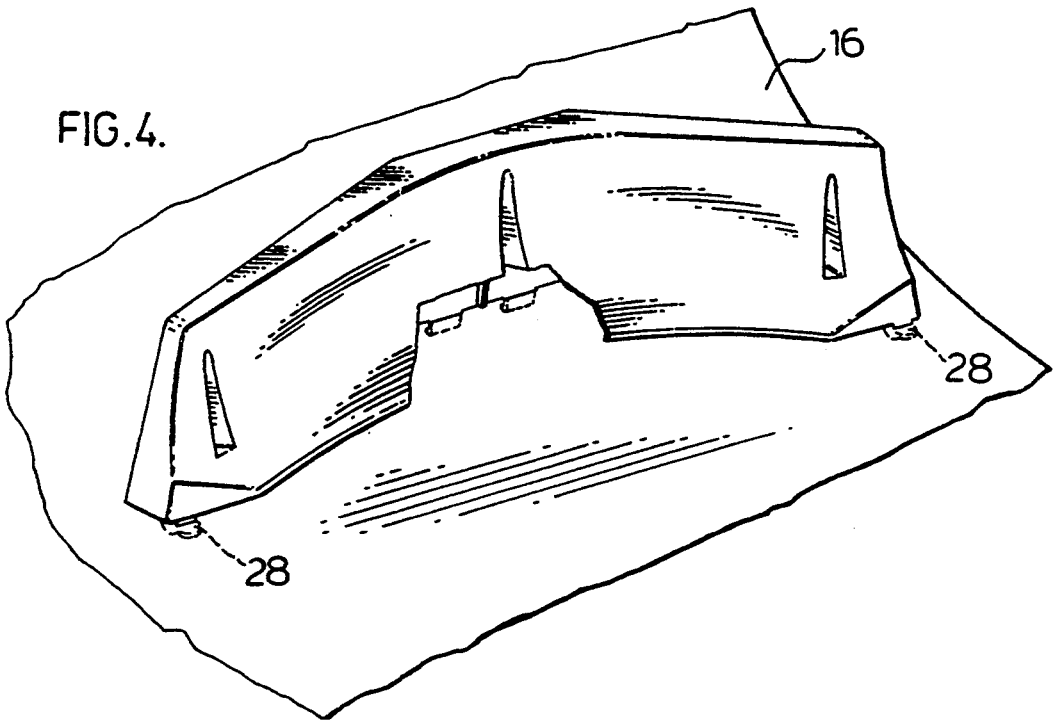
FIG. 4 is an enlarged sectional view of the baffle and dryer drum showing the attachment of the baffle to the drum.

Referring to FIG. 3, a partial perspective of a section of drum 16 will be found. Drum 16 is provided with two pairs of perforations 36 and 38 for insertion of tongues 28 (in perforations 36) and "hooking" members 32 (in perforations 38). In order to attach the baffle 24 into drum 16, the members 28 are inserted into perforations 36 and using these attachment points as a hinge, the baffle 24 is rotated backwardly until hooking members 32 contact the surface of drum 16. The installer then must press the rear surface of baffle 24 inwardly (toward the front surface of the baffle in the area of the two hooking members until the two hooking members 32 are aligned with perforations 38. The hooking members will now pass through perforations to the point where hooks 34 are beyond the exterior surface of drum 16, so that when the installer releases the pressure on the rear surface of the baffle the hooking members spring backwardly and lock hooks 34 against the exterior surface of drum 16. Removal is the reverse procedure. In this manner the baffles are quickly installed in or removed from drum 16 in short order by unskilled persons from the interior of the drum 16. No disassembly of the cabinet 12 of the dryer is required for the installation or removal of these baffles.

The advantages of the novel baffles will be obvious once the function of tongues 28 and hooking members 32 are disclosed. Installation of the baffles is instantaneous compared to prior art baffles. Baffles may be replaced by an unskilled homemaker if perchance a baffle is fractured by abuse, etc. And finally baffles of a different profile may be inserted by a homemaker if a special drying application is encountered. It is therefore seen that the baffle of this invention is efficient from a manufacturing and material point of view and it is versatile from a marketing and consumer point of view.

What is claimed is:

1. A baffle suitable for tumbling clothes in a clothes dryer of the rotating drum type, said baffle being essentially hollow, having front, rear, end and top walls integrally joined together to present a continuous surface to the clothes being tumbled, the lower portions of said front, rear and end walls being shaped to produce a good mating fit with the interior surface of the drum of said dryer, first means projecting from the lower surface of said front wall to engage said drum in a fastening manner, said first means comprising a plurality of projecting tongues extending forwardly from the lower surface thereof, and second means projecting from said rear wall to engage said drum in a fastening manner, said second means comprising at least one tab extending from the lower surface of said rear wall in a direction parallel to the rear surface of said baffle at the junction of tab and said rear wall.

2. A baffle suitable for tumbling clothes in a clothes dryer of the rotating drum type, said baffle being essentially hollow, having front, rear, end and top walls integrally joined together to present a continuous surface to the clothes being tumbled, the lower portions of said front, rear and end walls being shaped to produce a good mating fit with the interior surface of the drum of said dryer, first means projecting from the lower surface of said front wall to engage said drum in a fastening manner, said first means comprising a pair of projecting tongues extending forwardly from the lower surface thereof and second means projecting from said rear wall to engage said drum in a fastening manner, said second means comprising a pair of projecting tabs extending from the lower surface of said rear wall in a direction parallel to the rear surface of said baffle at the junction of the tab and the rear wall.

3. A baffle as claimed in claim 2 wherein said tongues are located near the end walls of the baffle.

4. A baffle as claimed in claim 2 wherein said tabs are located near the midpoint between the ends of said rear wall.

5. A baffle as claimed in claim 2 wherein said tongues are located near the end walls of said baffle and said tabs are located near the midpoint between the ends of said rear wall.

6. A baffle for a domestic clothes dryer of the rotating drum type which is of a suitable plastic material, said baffle being an integral assembly of an essentially hollow nature having top, front, rear, and end walls integrally formed together to produce a predetermined baffle shape, said front, rear and end wall bottom surfaces being suitably shaped to conform to the inside surface of the drum of the dryer when installed in said drum, the baffle having a pair of tongue-shaped projections extending forwardly from the lower surface of the front wall at locations near the end walls of said baffle and a pair of projecting members extending a predetermined distance below the bottom surface of said rear wall of said baffle, said projecting members having a pair of locking tabs extending rearwardly therefrom for locking the rear wall into said drum.

* * * * *